US006820625B2

(12) United States Patent
Park

(10) Patent No.: US 6,820,625 B2
(45) Date of Patent: Nov. 23, 2004

(54) METHOD FOR ATTACHING SUPPLEMENTAL HAIR TO HUMAN HAIR

(76) Inventor: Hui Suk Park, 11425 Mathis Ave., #406, 408, Farmers Branch, TX (US) 75234

( * ) Notice: Subject to any disclaimer, the term of this patent is extended or adjusted under 35 U.S.C. 154(b) by 4 days.

(21) Appl. No.: 10/159,094

(22) Filed: May 30, 2002

(65) Prior Publication Data

US 2004/0011372 A1 Jan. 22, 2004

(51) Int. Cl.[7] ..... A41G 3/00; A41G 5/00
(52) U.S. Cl. ..... 132/201
(58) Field of Search ..... 132/201, 271, 132/224, 53; 219/223, 275; 30/140

(56) References Cited

U.S. PATENT DOCUMENTS

| | | | | |
|---|---|---|---|---|
| 3,530,862 A | | 9/1970 | Hudson | |
| 4,830,029 A | | 5/1989 | Bird | |
| 4,870,250 A | * | 9/1989 | Rizzuto et al. | 219/225 |
| 4,934,387 A | | 6/1990 | Megna | |
| 4,982,748 A | | 1/1991 | Tramarchi | |
| 5,072,745 A | | 12/1991 | Cheh | |
| 5,107,867 A | | 4/1992 | Barrington | |
| 5,121,761 A | | 6/1992 | Meister | |
| 5,868,145 A | | 2/1999 | Spann | |
| 5,881,737 A | | 3/1999 | Nelson | |
| 5,894,846 A | * | 4/1999 | Gang | 132/201 |
| 5,899,209 A | | 5/1999 | McDonald et al. | |
| 5,954,062 A | | 9/1999 | Murata | |
| 6,085,755 A | | 7/2000 | Loren | |
| 6,135,122 A | | 10/2000 | Campbell et al. | |
| 6,135,124 A | * | 10/2000 | Grant | 132/271 |

* cited by examiner

*Primary Examiner*—John J. Wilson
*Assistant Examiner*—Robyn Kieu Doan
(74) *Attorney, Agent, or Firm*—Geoffrey A. Mantooth; L. Bruce Terry

(57) ABSTRACT

A method of attaching supplemental hair to natural human hair begins with selecting a plurality of strands of human hair growing from a scalp. A supplemental hair bundle includes a plurality of supplemental hair strands previously glued to one another at a glued portion by thermoplastic glue. A joint is formed between the glued portion of the supplemental hair bundle and the selected plurality of strands of human hair. The glued portion is fused using a heating element of an applicator. The heating element may be a heated jaw having a heating channel shaped to receive the glued portion of the bundle. A kneading jaw in opposing relationship to the heating jaw may be used to clamp the human hair and the supplemental hair bundle to mix the fused glue into the strands of human hair.

13 Claims, 3 Drawing Sheets

METHOD FOR ATTACHING SUPPLEMENTAL HAIR TO HUMAN HAIR

BACKGROUND OF THE INVENTION

1. Field of the Invention

The present invention relates generally to hair extension and an adornment, and more particularly to a method and apparatus for attaching supplemental hair to human hair to produce longer hair length or greater hair volume.

2. Description of the Prior Art

Frequently, a person may wish to supplement their own natural hair with supplemental hair in order to lengthen or increase the volume of hair in order to change their appearance or try on a new fashionable hair style. Thus, a person with short hair, or a person with sparse hair, may have a hair style that requires longer hair, or greater hair volume. The supplemental is hair may be made of natural human hair or synthetic fibers made to look like natural human hair.

In the prior art, supplemental hair strands may be attached or bonded to natural hair by several methods, such as tying, weaving, or gluing the supplemental hair to the person's natural hair.

An example of attaching supplemental hair by weaving or braiding is disclosed in U.S. Pat. No. 4,982,748 issued to Trimarchi. Trimarchi discloses intertwining or braiding of natural and synthetic hair followed by wrapping the braided portion of natural and synthetic hair with a portion of synthetic hair, which is then coated with a heat-hardenable sealer. Heat is applied to the wrapped braid using a pair of tipped members, which are adapted for mounting on the arms of a conventional heated curling iron. The tipped members include pointed portions and opposing flat surfaces for applying heat.

U.S. Pat. No. 4,934,387 issued to Magna discloses a method for lengthening hair by gluing supplemental hair to natural hair with thermoplastic adhesives dispensed from a glue gun. One problem with the Magna invention is that bundles of supplemental hair are not glued prior to gluing the supplemental hair bundled to the natural hair, which makes the Magna process difficult because a glue gun, the supplemental hair bundle, and the natural hair must all be manipulated simultaneously in a manner that may prove difficult for the operator.

U.S. Pat. No. 5,107,867 issued to Barrington shows supplemental hair plugs bonded by a thermostable adhesive, and coated with a thermosetting adhesive. The plug of supplemental hair is inserted into a small segment of heat shrinkable tubing with natural hair, and heat is applied to the heat shrinkable tubing so that the thermosetting adhesive liquefies and joins the plug of supplemental hair and natural hair while being compressed and sealed by the heat shrinkable tubing. The process shown in Barrington has the disadvantage of being tedious, awkward, and time consuming because hair plugs are bonded with two different materials and segments of heat shrinkable tubing are awkwardly threaded along the length of a bundle of a person's natural hair.

U.S. Pat. No. 5,072,745 issued to Cheh shows a bundle of supplemental hair joined together by hot melt adhesive. The supplemental hair bundle is bonded to a person's growing hair using an application tool to melt and dispense the adhesive. Disadvantages of Cheh include the inaccuracy in quantity of glue dispensed and the difficulty in evenly dispersing the glue that is initially deposited on only a few of the strands to be bonded.

The hair extension and adornment techniques known in the prior art have the problem of requiring extraordinary dexterity in the person applying the supplemental hair because supplemental hair bundles and sections of natural hair are difficult to bond using heat sources that do not assist in holding and mixing the combination of natural hair, supplemental hair, and thermoplastic adhesive.

Therefore, there is a need for an improved method and system for applying supplemental hair to natural human hair that provides tools and techniques that make it easier for the person applying the supplemental hair.

SUMMARY OF THE INVENTION

The invention is directed to a method and apparatus for attaching supplemental hair to natural human hair. The method begins with selecting a plurality of strands of human hair growing from a scalp. A supplemental hair bundle, which includes a plurality of supplemental hair strands previously glued to one another at a glued portion by thermoplastic glue, is fused using a heating element of an applicator. The glued portion of the supplemental hair bundle is then contacted to the selected plurality of strands of human hair. The heating element may be a heated jaw having a heating channel shaped to receive and heat the glued portion of the bundle. A kneading jaw having a kneading ridge in opposing relationship to the heating channel of the heating jaw may be used to clamp the human hair and the supplemental hair bundle, and to supply a manipulating force to mix the glue into the strands of human hair. Bundles are made by placing supplemental hair strands in a film of melted or fused glue coating the outer surface of a rotating cylinder that is partially submerged in a reservoir of fused glue.

BRIEF DESCRIPTION OF THE DRAWINGS

For a more complete understanding of the present invention, and the advantages thereof, reference is now made to the following descriptions taken in conjunction with the accompanying drawings, in which like numbers designate like parts, and in which.

DESCRIPTION OF THE PREFERRED EMBODIMENTS

Figure 1:
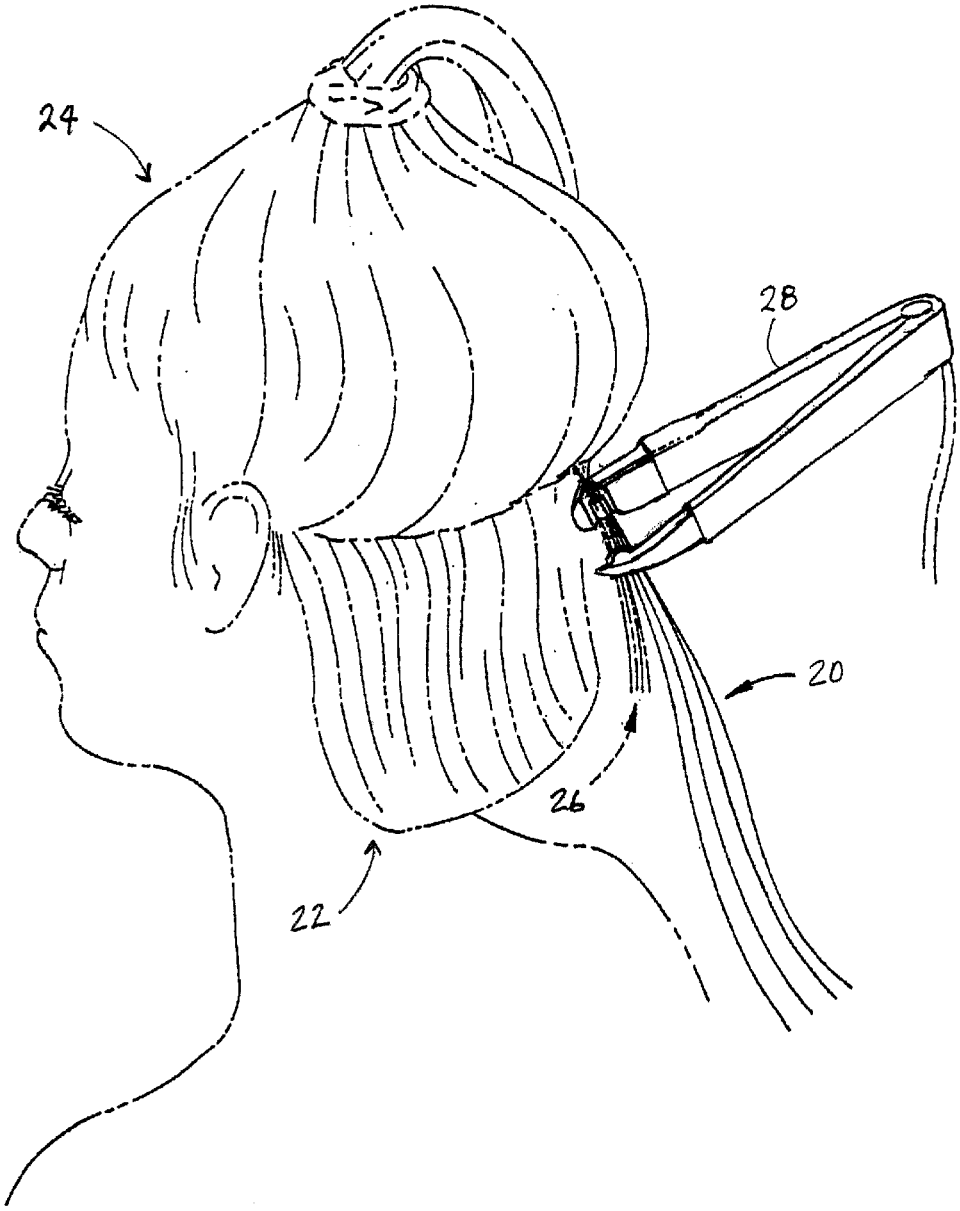
FIG. 1 depicts the attachment of a supplemental hair bundle to a selected plurality of strands of human hair using a supplemental hair applicator in accordance with the method and apparatus of the present invention.

With reference now to the drawings, and in particular with reference to FIG. 1, there is depicted the attachment of a supplemental hair bundle to a selected plurality of strands of human hair using a supplemental hair applicator in accordance with the method and apparatus of the present invention. As shown, supplemental hair bundle 20 is being attached, in general to natural human hair 22 growing from scalp 24, and more specifically, to a selected plurality of strands of human hair 26. Supplemental hair applicator 28 is used to fuse and knead a glued portion of supplemental hair bundle 20 using specially designed jaws, which are discussed in greater detail below.

The method of attaching supplemental hair of the present invention is easier than methods of the prior art because an operator in a salon or beauty parlor performs fewer steps and simultaneously manipulates fewer is objects, making the method of the present invention faster and more profitable for the operators. In the method of the present invention, the operator may hold in one hand the supplemental hair bundle 20 aligned with strands of human hair 26, and hold in the other hand supplemental hair applicator 28. As explained in greater detail below, the jaws of supplemental hair applicator 28 heat the thermoplastic glue of supplemental hair bundle 20 and hold both natural and supplemental hair strands in alignment as the heated glue and hair are kneaded or manipulated to mix and distribute the softened or melted glue so that it contacts and adheres to many of the hair strands.

Figure 2:
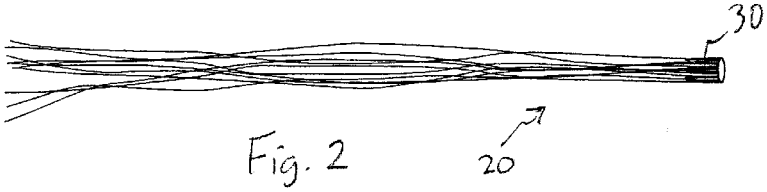
FIG. 2 is a side view of a supplemental hair bundle.

With reference now to FIG. 2, there is depicted a more detailed view of supplemental hair bundle 20. Glued portion 30 of supplemental hair bundle 20 glues strands of the bundle to each other with thermoplastic glue that softens or fuses above a predetermined temperature to a workable viscosity, and then solidifies or hardens as it cools. In a preferred embodiment, the thermoplastic glue is an ethylene-vinyl acetate (EVA) glue, with the following characteristics: a curing time of 0.3 to 0.5 seconds; a softening point (circular ball method) of ≧108° C.; a recommended operating temperature of 160° C.–180° C., wherein the glue is in a fluid state; a melt viscosity of 3000 mPa·s (millipascal second) at 140° C., 1450 mPa·s at 160° C., and 800 mPa·s at 180° C.; a peel stress of ≧370N/C $m^2$. To conceal the glue, a glue tinted the color of supplemental hair bundle 20 may be used.

Glued portion 30 is preferably cylindrically shaped, with a diameter of about 0.1 inches, and a length of about 0.5 inches. The dimensions of glued portion 30 are not critical, and may vary from one supplemental hair bundle 20 to another.

Figure 3:
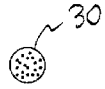
FIG. 3 is an end view of a supplemental hair bundle.

FIG. 3 shows an end view of glued portion 30, while not showing strands of supplemental hair in the background. As illustrated, glued portion 30 is round, and the ends of strands of supplemental hair are distributed throughout. Alternatively, glued portion 30 may be another shape, depending upon how it is manufactured. For example, glued portion 30 may be square, triangular, or diamond-shaped. Supplemental hair bundles 20 typically include, for example, from 50 to 60 hair strands, although the number of hair strands can be more or fewer. Length of the strands typically ranges from 3 inches to 40 inches, although again, the length can be longer or shorter.

Figure 4:
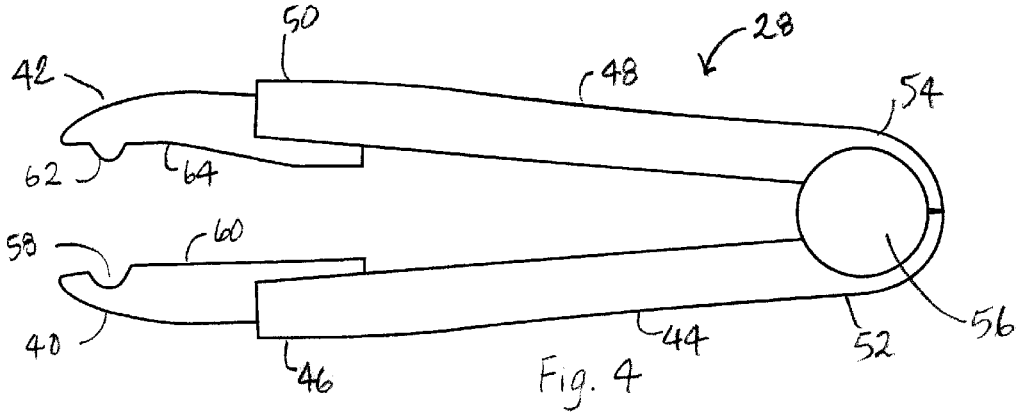
FIG. 4 depicts the supplemental hair applicator of the present invention in an open position.

Referring now to FIG. 4, there is illustrated a more detailed view of supplemental hair applicator 28 of the present invention. As illustrated, supplemental hair applicator 28 is in an open position, wherein heated jaw 40 and kneading jaw 42 are separated. Heated jaw 40 is mounted to heated jaw arm 44 on jaw end 46 of jaw arm 44. Kneading jaw 42 is mounted to kneading jaw arm 48 on jaw end 50 of jaw arm 44. Pivot end 52 of heated jaw arm 44 and pivot end 54 of kneading jaw arm 48 are pivotally connected by hinge joint 56. Hinge joint 56 preferably has a limited range of opening of about 10°, and is biased in the open position by a spring (not shown), which may be an integral part of hinge joint 56.

According to an important aspect of the present invention, heated jaw 40 includes heating channel 58, which extends into inside surface 60 of heated jaw 40. In a preferred embodiment, heating channel 58 is half-cylinder-shaped, extending across heated jaw 40 with an axis parallel to a rotational axis of hinge joint 56. Heating channel 58 is adapted to receive and apply heat to glued portion 30 of bundle of supplemental hair 20, and thus the shape corresponds to the shape of glued portion 30, which means for this embodiment, it has a length and radius approximately equal to the length and radius of glued portion 30. If glued portion 30 was a different shape, then heating channel 58 may also be different, preferably having a corresponding shape that efficiently transfers heat to glued portion 30. When power is supplied to supplemental hair applicator 28, heating channel 58 reaches a temperature that is sufficient to soften and make the glue of glued portion 30 adhere to strands of human hair 26, which is preferably 182.2° C. (360° F.). Power for heating heated jaw 40 may be provided by a cord plugged into a typical alternating-current electrical wall plug, similar to that used for a curling iron for hair.

Although both jaws of supplemental hair applicator 28 may be heated, in a preferred embodiment, heated jaw 40 is the only jaw that gets hot. The half-cylinder shape that conforms to the radius and length of glued portion 30 efficiently transfers enough heat to fuse or melt the thermoplastic glue. Having only one jaw heated reduces the likelihood of burning someone.

In an opposing relationship to heated jaw 40 and heating channel 58, kneading jaw 42 includes kneading ridge 62, which extends above inside surface 64 of kneading jaw 42. In a preferred embodiment, kneading ridge 62 is also half-cylinder-shaped, extending across kneading jaw 42 with an axis parallel to a rotational axis of hinge joint 56. One purpose of kneading ridge 62 is to provide a kneading surface to distribute melted glue among strands of human hair 26 and supplemental hair 20. Kneading ridge 62 clamps the strands of natural and supplemental hair, and works the glue and strands of natural and supplemental hair into a mass by manipulating and massaging the strands and glue, and as a result, the glue will coat and adhere to most, if not all, the strands.

Figure 5:
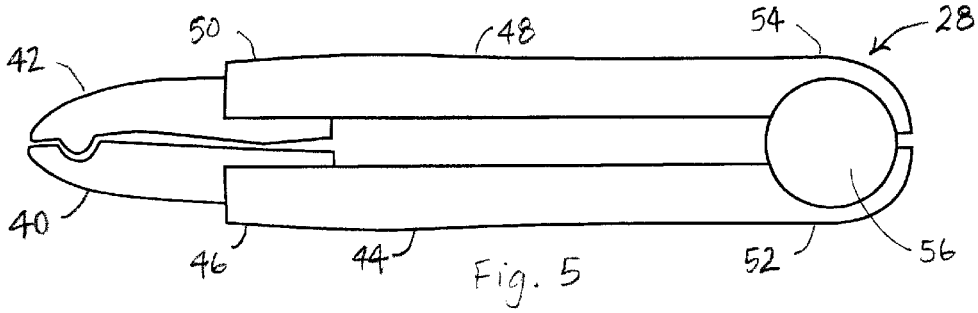
FIG. 5 illustrates the supplemental hair applicator of the present invention in a closed position.

Turning now to FIG. 5, supplemental hair applicator 28 is shown in a closed position, wherein heated jaw 40 and kneading jaw 42 are together. In this preferred embodiment, heating channel 58 and kneading ridge 62 are aligned with each other, wherein the axes of heating channel 58 and kneading ridge 62 are substantially parallel (at least when supplemental hair applicator 28 is closed), and wherein heating channel 58 and kneading ridge 62 are located about the same distance from hinge joint 56. In this preferred embodiment, kneading ridge 62 extends into heating channel 58 when supplemental hair applicator 28 is closed, which allows kneading ridge 62 to apply greater force to glued portion 30, and human hair 26 and supplemental hair 20.

The surfaces of heated jaw 40 and kneading jaw 42 are preferably coated with a material that is relatively non-sticky with respect to the thermoplastic glue in glued portion 30. For example, the outside surface of heated jaw 40 and kneading jaw 42 may be a non-stick coating. Examples of commercially available non-stick coatings are sold under the trademarks TEFLON® or SILVERSTONE® by E. I. du Pont de Nemours and Company.

Figure 6:
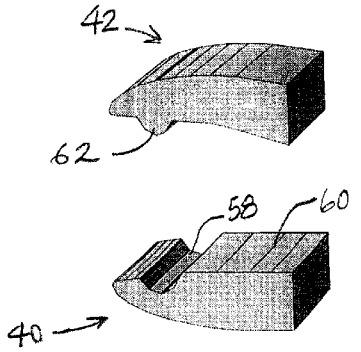
FIGS. 6 and 7 are isometric views of the jaws of the supplemental hair applicator of FIGS. 4 and 5.
Figure 7:
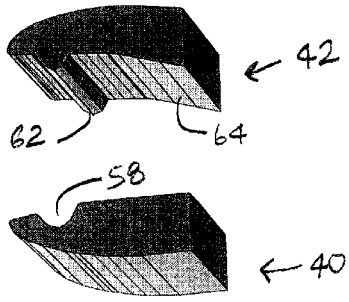

The isometric views of FIGS. 6 and 7 more clearly show the structure and relationship between heated jaw 40 and kneading jaw 42, and more specifically between heating channel 58 and kneading ridge 62. Heating channel 58 is concave, extending into and across inside surface 60 of heated jaw 40. Kneading ridge 62 is convex, extending outward and across inside surface 64 of kneading jaw 42.

In an alternative embodiment of the present invention, the axes of heating channel 58 and kneading ridge 62 may be askew from being parallel to the rotational axis of hinge joint 56 when supplemental hair applicator 28 is closed. If such a different angle is used, it may still be beneficial to keep the axes parallel (when the applicator is closed) and opposingly aligned with each other so that they meet when the applicator is closed, and cooperate to knead glued portion 30, human hair 26, and supplemental hair 20.

In another embodiment, supplemental hair applicator 28 may be implemented by adding specialized tips to an existing curling iron. Such tips may be similar to heated jaw 40 and kneading jaw 42, wherein heated jaw 40 may be coupled to the heated portion of the curling iron to collect heat, and kneading jaw 42 may be coupled to the non-heated, pivoting portion of a curling iron.

Figure 8:
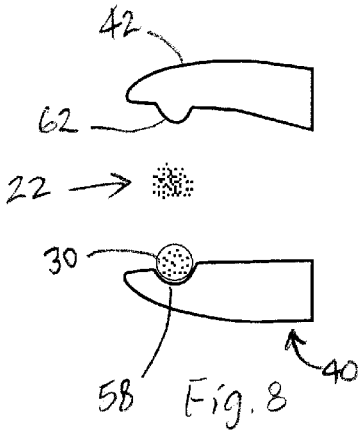
FIGS. 8, 9, and 10 more clearly illustrate the process of attaching a supplemental hair bundle to a selected plurality of strands of human hair using the supplemental hair applicator in accordance with the method and apparatus of the present invention.
Figure 9:
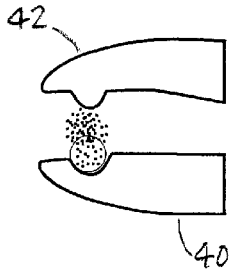
Figure 10:
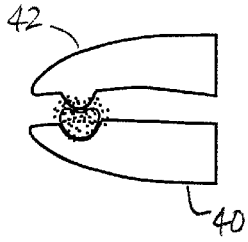

Referring now to FIGS. 8, 9, and 10, the operation of attaching supplemental hair to natural human hair is more clearly illustrated with the views along the axes of the strands of human and supplemental hair. After plugging in supplemental hair applicator 28 and allowing it to reach operating temperature, the operator selects a plurality of strands of natural human hair 22 growing from a scalp (not shown here). The operator then places glued portion 30 in heating channel 58 to soften or melt glued portion 30 of a supplemental hair bundle 20. For convenience, and to reduce the amount of handling required, the supplemental hair strands of the supplemental hair bundle have been previously glued to one another at the glued portion by thermoplastic glue. The heat source is applied by heating channel 58 of heated jaw 40. Once the glue is sufficiently melted and viscous, the operator contacts the glued portion of the supplemental hair bundle to the selected plurality of strands of human hair, as illustrated in FIG. 9.

After contacting the glued portion and the strands of human hair, the operator mixes melted glue in glued portion 30 of the supplemental hair bundle 20 into selected plurality of strands of human hair 22 by closing kneading jaw 42 of supplemental hair applicator 28 so that kneading ridge 62 on kneading jaw 42 moves toward heating channel 58 and contacts glued portion 30 and selected plurality of strands of human hair 22. As shown in FIG. 10, glued portion 30 is distorted, and glue is forced into contact with selected plurality of strands of human hair 22. This mixing and kneading process may include repeated openings and closings of jaws 40 and 42, and may include rotating the bundles of strands of natural and supplemental hair to knead at different angles.

After the mixing step, the operator may finish the attaching by kneading and manipulating the glued area by hand using his or her fingertips. When manipulating, the operator may roll the glued area to produce a smooth, rounded glued area that feels and styles better.

In an alternative method, glued portion 30 may be heated simultaneously with plurality of strands of natural human hair 22. That is, glued portion 30 may be located in heating channel 58 and overlaid with strands of human hair 22. Jaws 40 and 42 may then be closed to clamp down for a few moments as the glue softens and begins to mix with the natural human hair.

Figure 11:
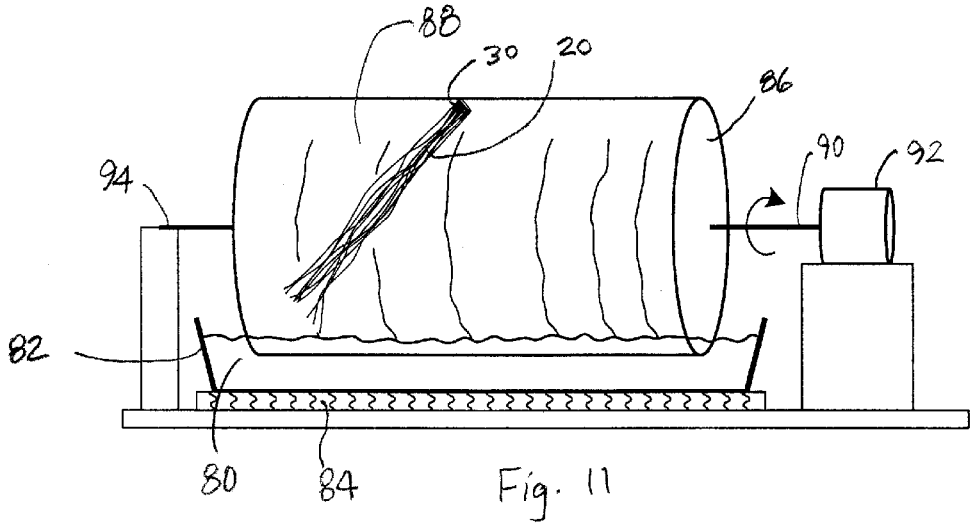
FIG. 11 depicts a method and apparatus for making a supplemental hair bundle accordance with the present invention.

With regard to FIG. 11, there is depicted a method and apparatus for making a supplemental hair bundle in accordance with the present invention. As shown, thermoplastic glue 80 is melted in glue reservoir 82 by applying heat from reservoir heater 84. Rotating cylinder 86 is partially submerged in melted thermoplastic glue 80 so that a fresh, hot film of melted thermoplastic glue 88 coats a non-submerged portion of rotating cylinder 86 as it turns.

The operator selects plurality of strands of supplemental hair 20 and arranges the strands so that they are substantially parallel and contacting adjacent strands to form a bunch with the ends that will be glued aligned with each other. Next, thermosetting adhesive is applied a to a portion of plurality of strands of supplemental hair (glued portion 30) by touching the portion of the plurality of strands to the film of melted thermoplastic glue 88. Some rotation of the bunch may help coat the strands more evenly.

To finish the bundle, the operator may wish to use his or her fingertips to knead and manipulate the glued portion into a more cylindrical shape with a smooth surface. Rolling the glued portion between fingertips may accomplish this finishing step. This method is a fast and efficient way to manufacture supplemental hair bundles 20.

Rotating cylinder 86 may be supported by shaft 90, which is coupled to motor 92 on one end and bearing 94 on the other. As is known by those skilled in the art, pulleys, gears, chains, belts, and the like may be used to provide an appropriate turning force and speed for rotating cylinder 86.

To allow for a variety of hair styles, and to accommodate people with different colored hair, supplemental hair bundles 20 may be manufactured in a variety of lengths and colors. The strands may be natural human hair, synthetic hair, or a mixture of these. Strands in supplemental hair bundle 20 may be all the same color, or a mixture of colors to create a stylish look.

A kit for attaching supplemental hair to natural human hair according to the present invention includes a plurality of supplemental hair bundles, each containing a plurality of supplemental hair strands previously glued to one another at a glued portion by thermoplastic glue, and a supplemental hair applicator. In a preferred embodiment of the kit, the supplemental hair bundles may be supplemental hair bundles 20 described herein. The supplemental hair applicator in the kit may be supplemental hair applicator 28, as described herein. The operator using the kit may reuse the supplemental hair applicator, and replenish the supply of supplemental hair bundles with new bundles.

The method and apparatus of the present invention has the advantage of making it easier for an operator to apply supplemental hair to natural human hair on a scalp by using supplemental hair strands previously glued to one another, and by aiding in the heating, aligning, and manipulating of the glue bond. Many of the prior art methods require awkward handling of glue applicators and parts to hold the glue bonded area.

The foregoing description of a preferred embodiment of the invention has been presented for the purpose of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method of attaching supplemental hair to natural human hair comprising the steps of:

selecting a plurality of strands of human hair growing from a scalp;

forming a joint between the strands of human hair and a glued portion of a supplemental hair bundle, wherein the supplemental hair bundle includes a plurality of supplemental hair strands previously glued to one another at the glued portion by thermoplastic glue;

fusing the glued portion of the supplemental hair bundle by directly contacting the joint and directly applying heat by contacting and clamping the joint with a heating channel of a heated jaw of a supplemental hair applicator by locating the joint in direct contact with the heating channel and contacting the glued portions with the selected plurality of strands of human hair, wherein the heating channel has a shape that matches a shape of the glued portion of the supplemental hair bundle;

clamping the joint between the glued portion of the supplemental hair bundle and the selected plurality of strands of human hair using the heating element; and kneading fused glue in the glued portion of the supplemental hair bundle while the glued portion is in contact with the selected plurality of strands of human hair by closing a kneading jaw of the supplemental hair applicator so that a kneading ridge on the kneading jaw moves toward the heating channel and contacts the glued portion and the selected plurality of strands of human hair.

2. The method of attaching supplemental hair according to claim 1 wherein the glued portion of the supplemental hair bundle is cylindrically shaped at one end of the supplemental hair bundle, and wherein the heating channel of the heated jaw of the supplemental hair applicator is concave to receive the cylindrically shaped end of the supplemental hair bundle.

3. The method or attaching supplemental hair according to claim 2 wherein the step of fusing a glued portion of a supplemental hair bundle further includes the step of applying heat along a length of a portion of half of a lateral face of the cylindrically shaped glued portion of the supplemental hair bundle.

4. The method of attaching supplemental hair according to claim 1 wherein the step of clamping the joint between the glued portion of the supplemental hair bundle and the selected plurality of strands of human hair further includes the step of mixing fused glue in the glued portion of the supplemental hair bundle into the selected plurality of strands of human hair.

5. The method of attaching supplemental hair according to claim 1 wherein the step of clamping the joint between the glued portion of the supplemental hair bundle and the selected plurality of strands of human hair further includes the step of clamping the joint between the glued portion of the supplemental hair bundle and the selected plurality of strands of human hair at a point near the scalp.

6. The method of attaching supplemental hair according to claim 1 further including the step of simultaneously heating the thermoplastic glue and kneading the supplemental hair bundle while the supplemental hair bundle is in contact with the selected plurality of strands of human hair.

7. The method of attaching supplemental hair according to claim 1 wherein the step of fusing the glued portion of a supplemental hair bundle further includes applying heat to the glued portion of a supplemental hair bundle by directly contacting the joint between the glued portion and the supplemental hair with a heating channel of a heated jaw of a supplemental hair applicator, wherein the shape of the heating channel is half-cylinder shaped.

8. The method of attaching supplemental hair according to claim 7 wherein the step of fusing the glued portion of a supplemental hair bundle by directly contacting a joint between the glued portion and the supplemental hair with a half-cylinder-shaped heating channel of a heated jaw of a supplemental hair applicator further includes directly contacting a joint between the glued portion and the supplemental hair with a half-cylinder-shaped heating channel of a heated jaw of a supplemental hair applicator, wherein the shape of the heating channel has an axis that extends across the heated jaw.

9. The method of attaching supplemental hair according to claim 8 wherein the step of fusing a glued portion of a supplemental hair bundle directly contacting a joint between the glued portion and the supplemental hair with a half-cylinder-shaped heating channel of a heated jaw of a supplemental hair applicator, wherein the shape of the heating channel has an axis that extends across the heated jaw further includes fusing a glued portion of a supplemental hair bundle directly contacting a joint between the glued portion and the supplemental hair with a half-cylinder-shaped heating channel of a heated jaw of a supplemental hair applicator, wherein the shape of the heating channel has an axis that extends across the heated jaw and parallel to an axis of a hinge of the supplemental hair applicator.

10. A method of attaching supplemental hair to natural human hair comprising the steps of:

selecting a plurality of strands of human hair growing from a scalp;

fusing a glued portion of a supplemental hair bundle, wherein the supplemental hair bundle includes a plurality of supplemental hair strands previously glued to one another at the glued portion by thermoplastic glue, wherein the fusing is performed by directly contacting the glued portion of the supplemental hair bundle with a heating element, wherein the heating element is part of a supplemental hair applicator that has a heated jaw with a heating channel, and a kneading jaw with a kneading ridge;

contacting the glued portion of the supplemental hair bundle to the selected plurality of strands of human hair; and kneading the fused glue in the glued portion of the supplemental hair bundle while the glued portion is in contact with the selected plurality of strands of human hair by closing the kneading jaw of the supplemental hair applicator so that the kneading ridge on the kneading jaw moves toward the heating channel and contacts and deforms the glued portion and the selected plurality of strands of human hair for making the fused glue into the selected plurality of strands of human hair.

11. A method of attaching supplemental hair to human hair comprising the steps of:

providing a heating tool having a heating channel on a heating jaw and a kneading ridge on a kneading jaw;

placing a joint between human hair and a glued portion of a supplemental hair bundle into the heating channel, wherein the glued portion includes supplemental hair strands bonded by cooled, previously applied thermoplastic glue;

clamping the joint of human hair and the glued portion between the heating channel and the kneading ridge; and fusing the glued portion with heat from the heating jaw.

12. The method of attaching supplemental hair to human hair according to claim 11 further including the step of kneading the fused glue in the glued portion of the supplemental hair bundle while the glued portion is in contact with the human hair by moving the kneading jaw of the heating tool so that the kneading ridge on the kneading jaw moves toward the heating channel and contacts and deforms the glued portion and the human hair for mixing the fused glue into the human hair.

13. A method of attaching supplemental hair to natural human hair comprising the steps of:

selecting a plurality of strands of human hair growing from a scalp;

fusing a glued portion of a supplemental hair bundle by applying heat using a heating channel of a heated jaw of a supplemental hair applicator by locating the glued portion in the heating channel and contacting the glued portion with the selected plurality of strands of human hair, wherein the supplemental hair bundle includes a plurality of supplemental hair strands previously glued to one another at the glued portion by thermoplastic glue, and wherein the heating channel has a shape that matches a shape of the glued portion of the supplemental hair bundle;

contacting the glued portion of the supplemental hair bundle to the selected plurality of strands of human hair;

clamping the glued portion of the supplemental hair bundle to the selected plurality of strands of human hair while the glued portion is fusing; and kneading the fused glue in the glued portion of the supplemental hair bundle while the glued portion is in contact with the selected plurality of strands of human hair by closing a kneading jaw of the supplemental hair applicator so that a kneading ridge on the kneading jaw moves toward the heating channel and contacts the glued portion and the selected plurality of strands of human hair.

* * * * *